United States Patent [19]

Lowes

[11] Patent Number: 4,501,514

[45] Date of Patent: Feb. 26, 1985

[54] SECURING OF STRUCTURES TO THE SEA-BED

[75] Inventor: John M. Lowes, Dalton-in-Furness, England

[73] Assignee: British Underwater Pipeline Engineering, England

[21] Appl. No.: 295,075

[22] Filed: Aug. 21, 1981

[30] Foreign Application Priority Data

Sep. 8, 1980 [GB] United Kingdom ..... 8028940

[51] Int. Cl.[3] ..... E02D 5/54; B21D 39/04

[52] U.S. Cl. ..... 405/227; 405/224

[58] Field of Search ..... 405/227, 224, 195; 72/58; 29/421 R, 523; 166/55, 297, 277; 138/98

[56] References Cited

U.S. PATENT DOCUMENTS

| | | | |
|---|---|---|---|
| 2,093,092 | 9/1937 | McElhany et al. | 29/421 |
| 3,111,991 | 11/1963 | O'Neal | 166/277 X |
| 3,224,204 | 12/1965 | Siebenhausen | 405/227 |
| 3,375,670 | 4/1968 | Serota | 29/523 X |
| 3,412,565 | 11/1968 | Lindsey et al. | 29/523 X |
| 3,447,607 | 6/1969 | Harris et al. | 166/297 X |
| 3,555,831 | 1/1971 | Pogonowski | 405/227 |
| 3,587,194 | 6/1971 | Brown | 166/55 X |
| 3,977,068 | 8/1976 | Krips | 29/421 R |
| 4,078,391 | 3/1978 | Pogonowski | 405/224 X |
| 4,125,937 | 11/1978 | Brown et al. | 29/421 R X |
| 4,142,581 | 3/1979 | Yoshitomi et al. | 29/523 X |

FOREIGN PATENT DOCUMENTS

| | | | |
|---|---|---|---|
| 1563740 | 3/1980 | United Kingdom | 405/224 |
| 2074914 | 11/1981 | United Kingdom | 29/523 |

*Primary Examiner*—Stephen J. Novosad
*Assistant Examiner*—Beverly E. Hjorth
*Attorney, Agent, or Firm*—Larson and Taylor

[57] ABSTRACT

Structures such as free standing oil production platforms or subsea templates are secured to the sea bed by inserting a tubular pile in the seabed so as to form, with a part of the structure a pair of nested members. Fluid is then introduced into the innermost of the members to plastically deform the innermost member radially so that it engages with the outermost member and forms a mechanical connection between the members. A tool for effecting the plastic deformation comprises a mandrel for insertion into the innermost member and carrying a means to form a chamber within the innermost member and adjacent to its inner surface. The tool also includes a means of introducing fluid into the chamber to expand it radially and thereby deform the innermost member.

10 Claims, 7 Drawing Figures

SECURING OF STRUCTURES TO THE SEA-BED

Figure 2:
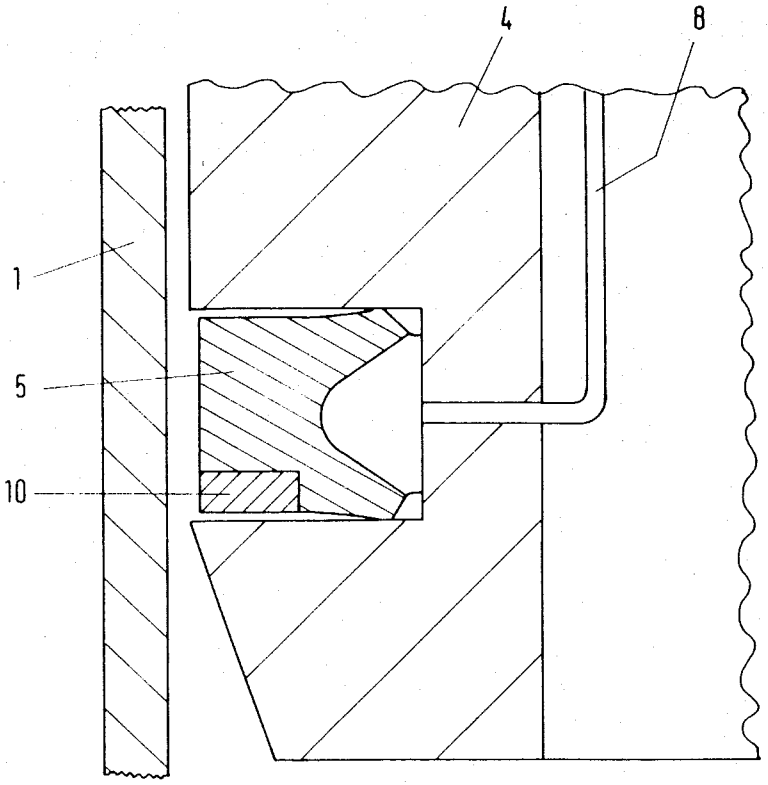

This invention relates to the securing of structures to the sea bed.

In the course of offshore oil and gas exploration and production, large structures, such as free-standing production platforms or subsea templates for use with tethered floating platforms, are frequently required to be anchored to the seabed. Such structures require a substantial foundation and this is normally provided by the use of tubular piles driven into the seabed.

When anchoring free-standing platforms in shallow water, it is normally sufficient to drive piles down the main legs of the platform and to join the legs to the top of the piles by welding. In deeper waters where very tall platforms are needed, it has become normal practice to provide an array of piles around base of the jacket in order to increase the axial load carrying capacity which is required for such tall structures. Moreover, in order to reduce the affects of waves and surface currents on the platform and hence reduce the loading it is usual for the piles to terminate well below the water surface. In such circumstances, it is not normally possible to weld the structure to the piles and therefore an alternative connecting procedure has been adopted. In accordance with this procedure, the structure is provided with tubular sleeves arranged to fit over the piles and a grouting material is then injected into the annular cavity formed between each sleeve and its associated pile. In order to be able to do this, it is necessary to insert packers at the top and bottom of the cavity. Then the grouting material is pumped into the cavity from the bottom and returns via a line to the surface. Disadvantages of this technique are the requirement to insert packers and the need to use an extensive network of pipes.

Also an accurate check on the integrity of the joint is difficult.

It is an object of the present invention to avoid these disadvantages.

According to one aspect of the present invention there is provided a method of securing a structure to the seabed which comprises placing the structure on the seabed, inserting a tubular pile into the seabed, so that the tubular pile and a part of the structure form a pair of nested members, and introducing a fluid into the interior of the innermost of the members so as to plastically deform said innermost member radially and cause it to engage with the outermost of the members so as to form a mechanical connection between the members.

Generally, the tubular pile will be the innermost member and said part will be the outermost member.

When carrying out the method of the present invention, the innermost member is deformed hydraulically, the pressurising fluid acting on the inner surface of the innermost member either directly or through the intermediary of an additional member. Thus, the innermost member is subjected to hydraulic forming and not to mechanical deformation. The pressure in the interior of the innermost member must be such that the innermost member is plastically deformed in order to obtain the desired connection. Provided that the innermost member is plastically deformed the outermost member need only be elastically deformed for a mechanical interference between the members to be achieved. The inner surface of the outermost member may be provided with one or more suitable recesses to receive the deformed part of the innermost member and thereby to increase the strength of the connection.

Said part of the structure may be in the form of an axially extending tubular sleeve.

In an alternative embodiment, and in the case where the tubular pile is the innermost member, said part of the structure may be in the form of a plurality of spaced plates each including an aperture to receive the pile. In this case, the bulk of the plastic deformation of the pile takes place in the region(s) between adjacent plates.

According to a second aspect of the present invention there is provided a tool for radially deforming an innermost member disposed within an outermost member in accordance with the foregoing method which tool comprises (a) a mandrel for inserting into the innermost member, (b) means mounted on the mandrel such that when the mandrel is inserted into the innermost member a chamber is formed in the interior of the innermost member at the outer surface of the mandrel and adjacent to the inner surface of the innermost member, and (c) means for introducing fluid into the chamber to expand it radially and thereby cause radial deformation of the innermost member.

In one form of the tool of the invention the chamber is bounded by the inner surface of the innermost member in which case the pressure in the chamber acts directly on the inner surface of the innermost member when radially deforming the same. In this case, the chamber forming means may comprise first and second inflatable sealing elements housed in circumferential grooves spaced axially along the outer surface of the mandrel. The mandrel will then include a conduit leading to the grooves to enable suitable fluid, for example water, under high pressure to be introduced into the sealing elements after the mandrel has been inserted into the innermost member so as to expand the sealing elements into sealing engagement with the outer surface of the mandrel and the inner surface of the innermost member. In this case the desired chamber is in the form of an annular cavity bounded by the sealing elements, the outer surface of the mandrel and the inner surface of the innermost member. The mandrel will also include at least one other conduit terminating in its outer surface at the location between the first and second sealing elements whereby suitable fluid, for example water, may be introduced into the chamber to effect the desired deformation of the innermost member. If desired, the mandrel may include more than two such sealing elements and grooves therefor as necessary in order to achieve the desired seal.

In another form of the tool of the present invention, the chamber includes a wall adjacent to the inner surface of the innermost member in which case the pressure in the chamber acts through said wall when radially deforming the innermost member. In this case, the chamber forming means may be as above described but with the first and second sealing elements joined together by a cylindrical sleeve. In an alternative embodiment, the chamber forming means may be in the form of a cylindrical member which is mounted on the outer surface of the mandrel and which is formed in such a way as to be resistant to axial deformation but capable of being deformed radially by pressurising fluid emanating from the mandrel. A similar affect can be obtained by using a sealing means in the form of a plurality of axially spaced inflatable rings. These embodiments are particularly useful where the inner surface of the innermost member includes a discontinuity such as a weld bead, which may cause difficulty in sealing.

Figure 1:
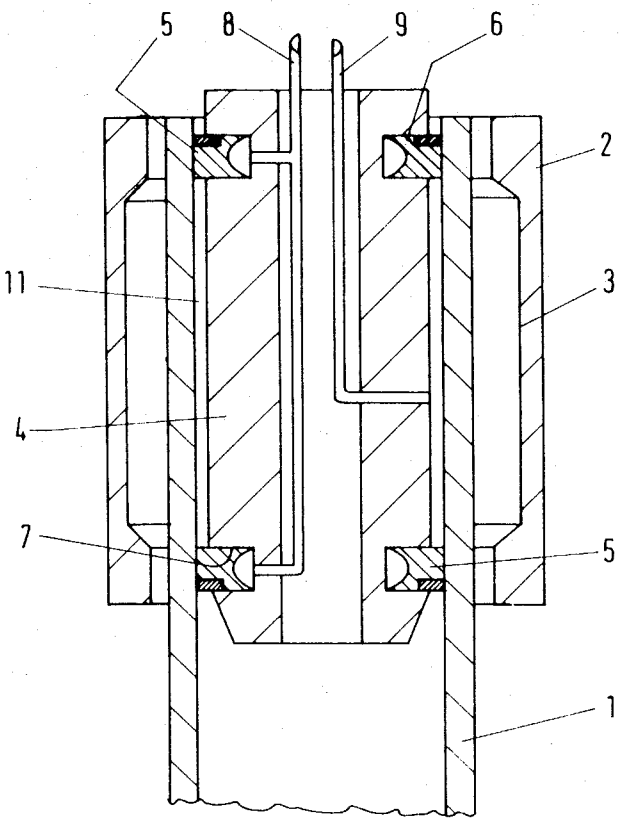
Figure 4:
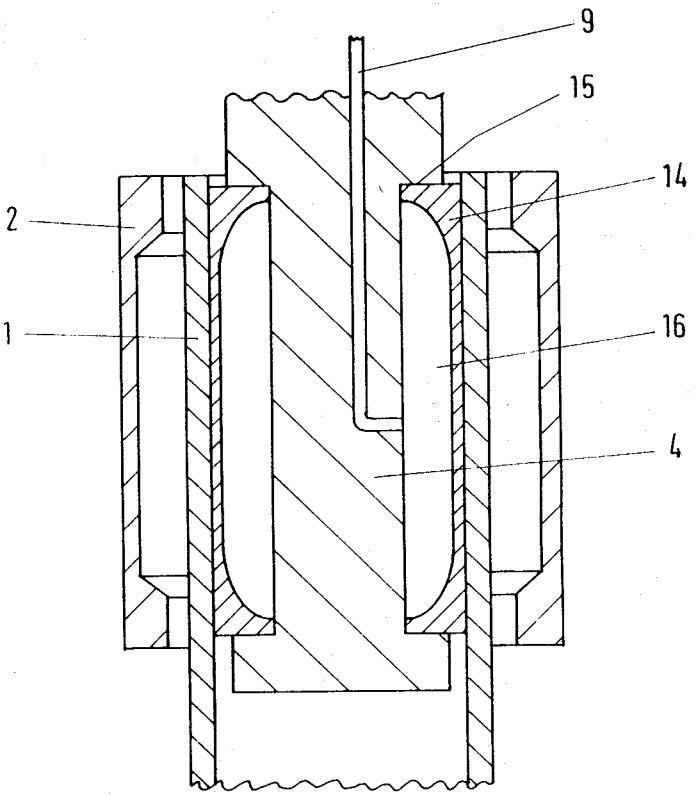
Figure 3:
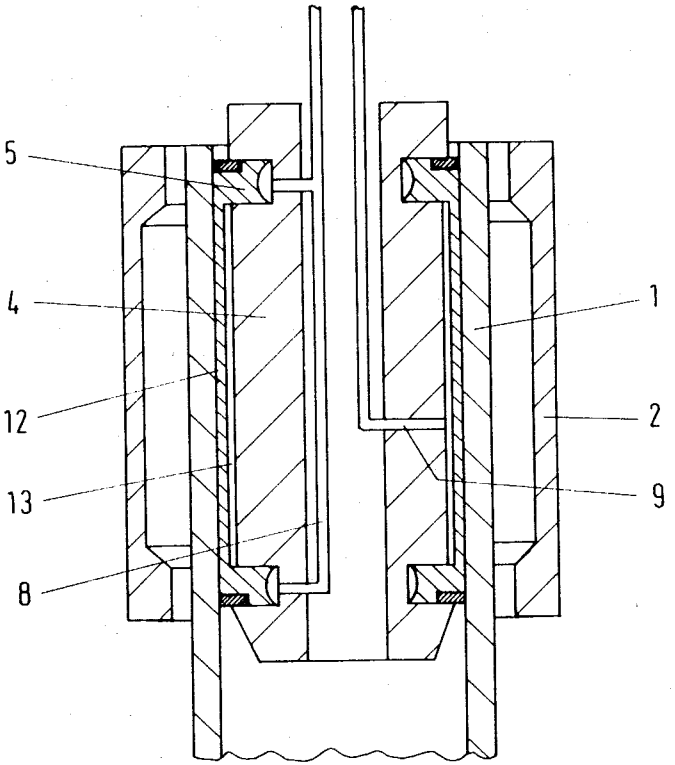
Figure 5:
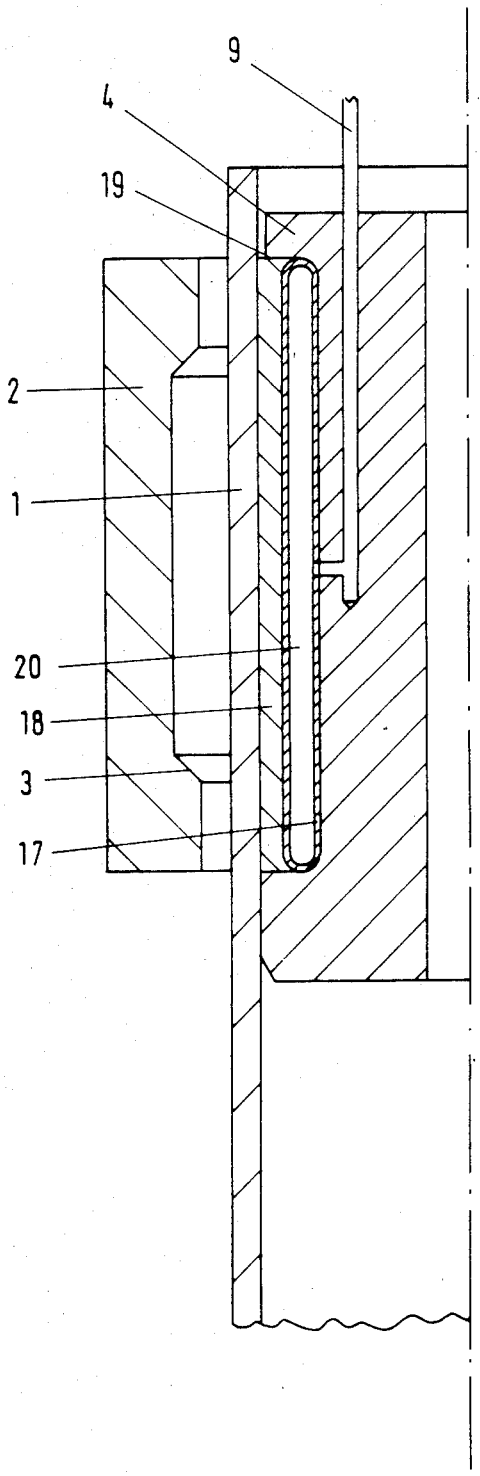
Figure 6:
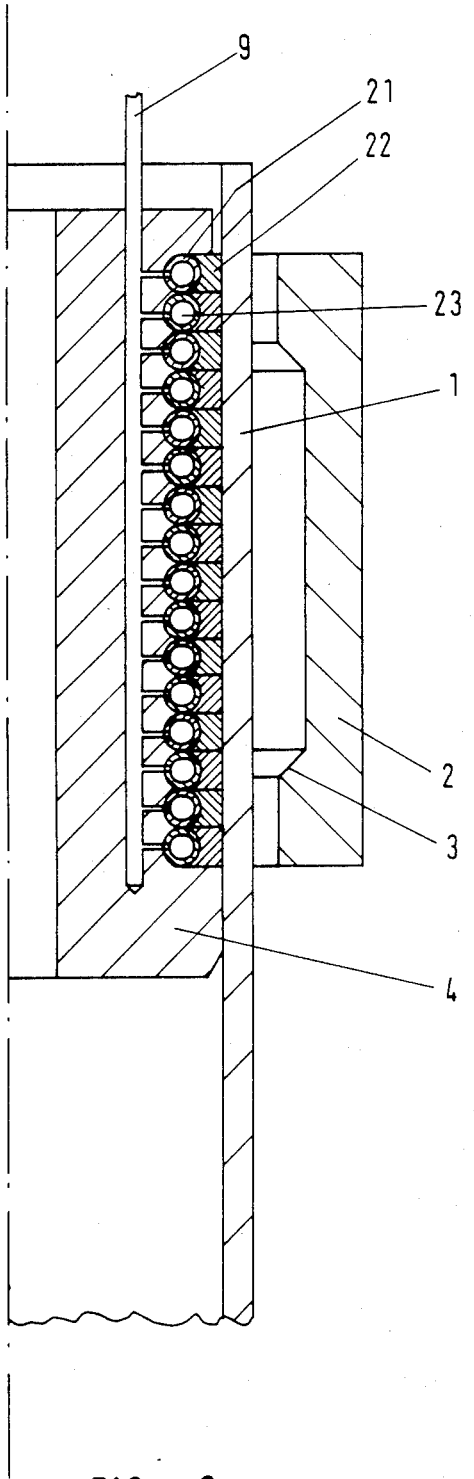
Figure 7:
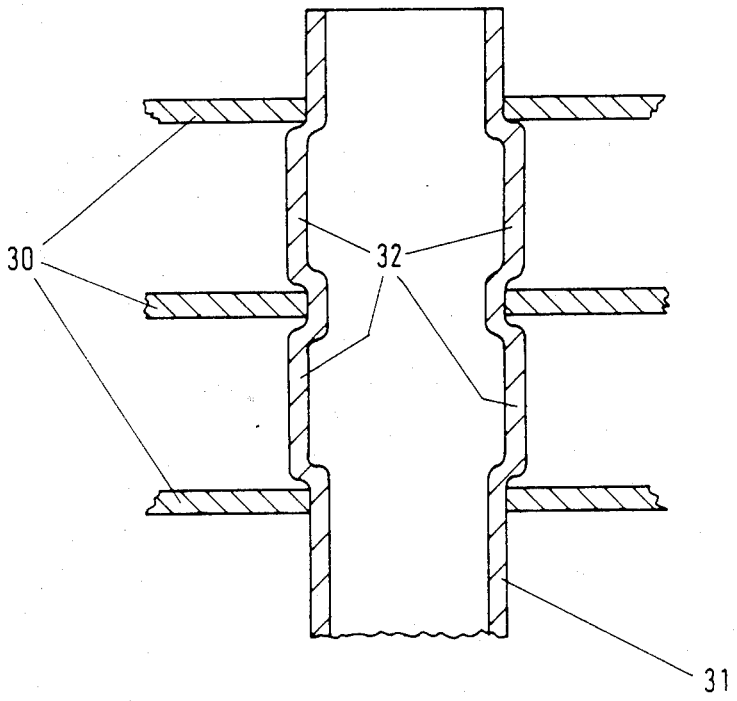

For a better understanding of the invention and to show how the same may be carried into effect, reference will now be made, by way of example, to the accompanying drawings in which:

FIG. 1 is a cross-section through a first embodiment of a tool for use in accordance with the present invention in securing a tubular pile into a tubular sleeve, FIG. 2 shows a part of FIG. 1 on an increased scale, FIG. 3 is a cross-section through a second embodiment of such a tool, FIG. 4 is a cross-section through a third embodiment of such a tool, FIG. 5 is a cross-section through a fourth embodiment of such a tool, FIG. 6 is a cross-section through a fifth embodiment of such a tool, and FIG. 7 is a cross-section through a part of a structure and a tubular pile secured together in accordance with the present invention.

Referring now to FIGS. 1 and 2, there is shown a tubular steel pile 1 which has been driven into the seabed and to which the jacket of a free-standing oil production platform is to be secured. The pile 1 terminates well below the surface of the water and is one of a plurality of similar piles. Typically, the piles may be from 20 to 84 inches in diameter with a diameter to thickness ratio of about 30. The jacket includes a plurality of tubular steel sleeves and each sleeve is located around a pile 1 to form a plurality of pairs of nested members, the innermost member of each pair being the pile and the outermost member of each pair being the sleeve. Only one such sleeve is shown and this is denoted by reference numeral 2. The inner surface of each tubular sleeve is provided with a circumferential swage groove 3.

The tool of the present invention comprises a mandrel 4 formed of steel and being of such a dimension that it can be inserted into the interior of the tubular pile 1. A chamber-forming means is mounted on the mandrel 4. This comprises a pair of inflatable flexible sealing elements 5 which are located in a pair of circumferential axially spaced grooves 6 and 7 provided on the outer surface of the mandrel 4. The mandrel includes a first conduit 8 leading to each of the grooves 6 and 7 whereby the sealing elements 5 may be hydraulically pressurised. The mandrel also includes another conduit 9 which terminates in its outer surface at a location disposed between the two sealing elements 5. Each sealing element 5 is in the form of a rubber ring having a generally U-shaped cross-section and including a steel backing ring 10 to prevent axial distortion of the ring when under pressure (see FIG. 2 where the sealing element is shown prior to inflation.

In use, the mandrel is inserted into the interior of the tubular pile 1 as shown and water is introduced into conduit 8 so as to pressurise the sealing elements 5 and cause them to seal against the mandrel and against the inner surface of the tubular pile 1 so as to form a chamber in the form of a closed annular cavity 11 bounded by the outer surface of the mandrel, the inner surface of the tubular pile 1, and the sealing elements 5. Water is then introduced into conduit 9 to pressurise the annular cavity 11 which will ordinarily already contain water. The pressure is transmitted through the water in the cavity so as to act directly on the inner surface of the tubular pile 1. The pressure radially expands the cavity by deforming the walls of the pile 1 into conformity with the groove 3 of the tubular sleeve 2. The pressures used are such that the wall of the tubular pile 1 deforms plastically so that a mechanical interference is produced between the pile 1 and the sleeve 2 so as to form the desired connection. Generally, the pressure in the sealing elements 5 will be higher than the pressure in the cavity 11 (for example 10 psi higher) and this can be achieved either by using separate sources of pressure or by using a common source and appropriate check valves in the conduits 8 and 9.

Referring now to FIG. 3, parts corresponding to parts of FIGS. 1 and 2 are denoted by like reference numerals. In this embodiment, the two sealing elements 5 are linked together by a cylindrical sleeve 12. In this case the chamber is in the form of an annular cavity 13 bounded by the outer surface of the mandrel 4, the sealing elements 5 and the inner surface of the sleeve 12 and the pressure in the cavity 13 is transmitted to the inner surface of the pile 1 through the sleeve 12.

In FIG. 4, parts corresponding to parts of FIGS. 1 and 2 are denoted by like reference numerals. In this embodiment, the chamber forming means is a cylindrical member 14 mounted in a broad groove 15 on the mandrel 4. The member 14 has a generally U-shaped cross-section and defines a chamber in the form of an annular cavity 16 with the surface of the mandrel. The member 14 is formed of rubber reinforced with steel in such a way that it is resistant to axial deformation but is capable of expanding radially when the cavity 16 is pressurised by pressurising fluid from conduit 9. The pressure of the fluid in the cavity 16 is transmitted to the tubular pile 1 through the member 14.

Referring now to FIG. 5, parts corresponding to parts of FIGS. 1 and 2 are denoted by like reference numerals. In this case, the chamber-forming means is an inflatable toroidal envelope 17 carrying a segmented pad 18. The chamber forming means is mounted in a broad circumferential groove 19 on the outer surface of the mandrel 4 with its pad 18 adjacent to the inner surface of the tubular pile 1. The envelope 17 defines a toroidal chamber 20 which can be pressurised by pressurising fluid from conduit 9. The pressurising fluid deforms the tubular pile 1 by radially expanding the chamber 20.

In FIG. 6, parts corresponding to parts of FIGS. 1 and 2 are denoted by like reference numerals. In this embodiment the mandrel includes a plurality of chamber-forming means mounted in a groove on its outer surface. Each chamber forming means is an inflatable ring 21 carrying a segmented ring 22 which is located adjacent to the inner surface of the tubular pile 1 and each ring 21 is in communication with conduit 9 for pressurising fluid. In use pressurising fluid is introduced into the chambers 23 constituted by the interiors of rings 21. The pressure causes the tubular pile 1 to be deformed into conformity with groove 3 by radially expanding the chamber 23.

Referring to FIG. 7, there is shown a part of a free standing oil production platform which comprises a plurality of steel plates each denoted by reference numeral 30. Each of the plates 30 include an aperture, the apertures being aligned so that they can be fitted around a tubular pile 31 which initially is of substantially constant cross-section. Thus, the pile 31 and plates 30 constitute a pair of nested members, the innermost of the members being the pile 31 and the outermost of the members being the plates 30. By introducing fluid into the interior of the pile in the manner previously described, the pile is plastically deformed radially outwards, at least in regions 32 intermediate adjacent plates 30, so that it mechanically engages with the plates and is connected thereto.

Although the invention has been described with particular reference to the securing of the jacket of a free-standing oil production platform to underwater piles, it will be appreciated that the invention is equally applicable to the anchoring of other structures. Further, if desired the inner surface of the tubular sleeve 2 may be provided with more than one recess to receive the pile 1 on deformation thereof and a single tool be used to deform the pile into all of the recesses simultaneously.

I claim:

1. A method of securing a structure to the sea bed which comprises placing the structure on the sea bed, inserting a tubular pile into the sea bed so that the tubular pile and a part of the structure form a pair of nested members comprising an innermost member and an outermost member, introducing into the innermost of the members a mandrel carrying, on its outer surface, inflatable means provided with reinforcement to prevent axial distortion of the same, and introducing a fluid into the interior of the innermost member so as to inflate said inflatable means and thereby define a sealed annular chamber between the outer surfaces of the mandrel and the inner surface of said innermost of the members while providing positioning of said reinforcement in the space between the outer surface of the mandrel and the inner surface of the innermost of the two members so as to prevent axial distortion of said inflatable means and to radially expand the chamber and thereby plastically deform said innermost member radially and cause it to engage with the outermost of the members so as to form a mechanical connection between the members.

2. A method according to claim 1 wherein the tubular pile is the innermost member and said part is the outermost member.

3. A method according to claim 2, wherein said part is in the form of a tubular sleeve.

4. A method according to claim 3 wherein the inner surface of the tubular sleeve is provided with a recess to receive a part of the pile on deformation thereof.

5. A method according to claim 1 wherein the fluid acts directly on the inner surface of the innermost member when deforming the same.

6. A method according to claim 1 wherein the innermost member is deformed by the fluid acting on the inner surface of the innermost member through the intermediary of an additional member located adjacent said inner surface.

7. A method according to claim 1 wherein said means comprises first and second axially spaced inflatable rings, each ring being housed in a circumferential groove in the outer surface of the mandrel, and including, as said reinforcement, a steel backing ring.

8. A method according to claim 7, wherein said inflatable rings are joined together by a cylindrical sleeve whereby the chamber is in the form of an annular cavity bounded by the inflatable rings, the outer surface of the mandrel, and the cylindrical sleeve.

9. A method according to claim 1 wherein said means is in the form of an inflatable toroidal envelope including, as said reinforcement, pad located between the envelope and the inner surface of the innermost members.

10. A method according to claim 1 wherein the inner surface of said outermost member is provided with a recess to receive the innermost member on deformation thereof.

* * * * *